United States Patent [19]

Ikeda et al.

[11] Patent Number: 4,921,784

[45] **Date of Patent: * May 1, 1990**

[54] SILVER HALIDE EMULSION CONTAINING A THIOCYANATE COMPOUND HAVING SPECIFIC ABSORBANCE IN IR SPECTROSCOPY

[75] Inventors: Hideo Ikeda; Ryoichi Nemori, both of Kanagawa, Japan

[73] Assignee: Fuji Photo Film Co., Ltd., Minami-ashigara, Japan

[ * ] Notice: The portion of the term of this patent subsequent to Aug. 1, 2006 has been disclaimed.

[21] Appl. No.: 886,052

[22] Filed: Jul. 16, 1986

[30] Foreign Application Priority Data

Jul. 18, 1985 [JP] Japan ..... 60-158891

[51] Int. Cl.[5] ..... G03C 1/08

[52] U.S. Cl. ..... 430/567; 430/603; 430/605

[58] Field of Search ..... 430/603, 605, 567

[56] References Cited

U.S. PATENT DOCUMENTS 3,320,069 5/1967 Illingsworth ..... 430/603

4,111,697 9/1978 Pollet et al. ..... 430/607

*Primary Examiner*—Paul R. Michl

*Assistant Examiner*—Mark R. Buscher

*Attorney, Agent, or Firm*—Burns, Doane, Swecker & Mathis

[57] ABSTRACT

A thiocyanate-containing silver halide emulsion, characterized in that a disc tablet of 2.5 mm in diameter formed of 10 mg of silver halide contained in the silver halide emulsion shows an absorbance of 0.015 or higher or thiocyanate ion at 2052 $cm^{-1}$, measured by IR spectroscopy. The emulsion is high in sensitivity, small in loss of photographic sensitivity caused by pressure and small in fluctuations in results of photographic processings.

4 Claims, 1 Drawing Sheet

SILVER HALIDE EMULSION CONTAINING A THIOCYANATE COMPOUND HAVING SPECIFIC ABSORBANCE IN IR SPECTROSCOPY

BACKGROUND OF THE INVENTION

1. Field of the Invention

The present invention relates to a silver halide emulsion, particularly to a silver halide emulsion which has high sensitivity and small pressure desensitization.

2. Description of the Prior Art

It is an invariable task in the industry of silver halide photographic materials to obtain high speed light sensitive materials and there are numerous patents for this. Among these, U.S. Pat. No. 3,320,069 describes that thiocyanate is used during formation of emulsion grains. However, the technique specifically described in this patent fails to yield sufficient sensitivity, and pressure resistance and treatment condition dependency (latitude) are also unsatisfactory.

SUMMARY OF THE INVENTION

The purpose of the present invention is to provide a silver halide photographic emulsion which is highly sensitive and shows small loss of photographic sensitivity caused by pressure and small fluctuations in results of treatment, by modifying the method in which thiocyanate is used during the formation of the emulsion grains.

It has now been found that there are three states of thiocyanate ion contained in the emulsion grains, i.e., states corresponding to IR absorbing peaks of 2106 $cm^{-1}$, 2073 $cm^{-1}$ and 2052 $cm^{-1}$ and it is important to photographic characteristics, pressure resistance and treatment condition dependency of the emulsion to control the absorbance at 2052 $cm^{-1}$.

The aforesaid purpose of the invention is attained by a thiocyanate-containing silver halide emulsion, characterized in that a disc tablet of 2.5 mm in diameter formed of 10 mg of silver halide contained in the silver halide emulsion shows an absorbance 0.015 or higher of thiocyanate ion at 2052 $cm^{-1}$, measured by IR spectroscopy.

BRIEF DESCRIPTION OF THE DRAWING

The accompanying figure shows spectra of thiocyanate ion by the IR spectroscopic absorption method described in (2) of Example 1. In the figure, spectrum 1 corresponds to emulsion 1; spectrum 2, emulsion 2; and spectrum 3, emulsion 2 which was not washed with an aqueous KBr solution of a concentration of 10 g/l during the procedure of preparing silver halide powder for IR spectroscopic absorption measurement.

DETAILED DESCRIPTION OF THE INVENTION

Figure 1:
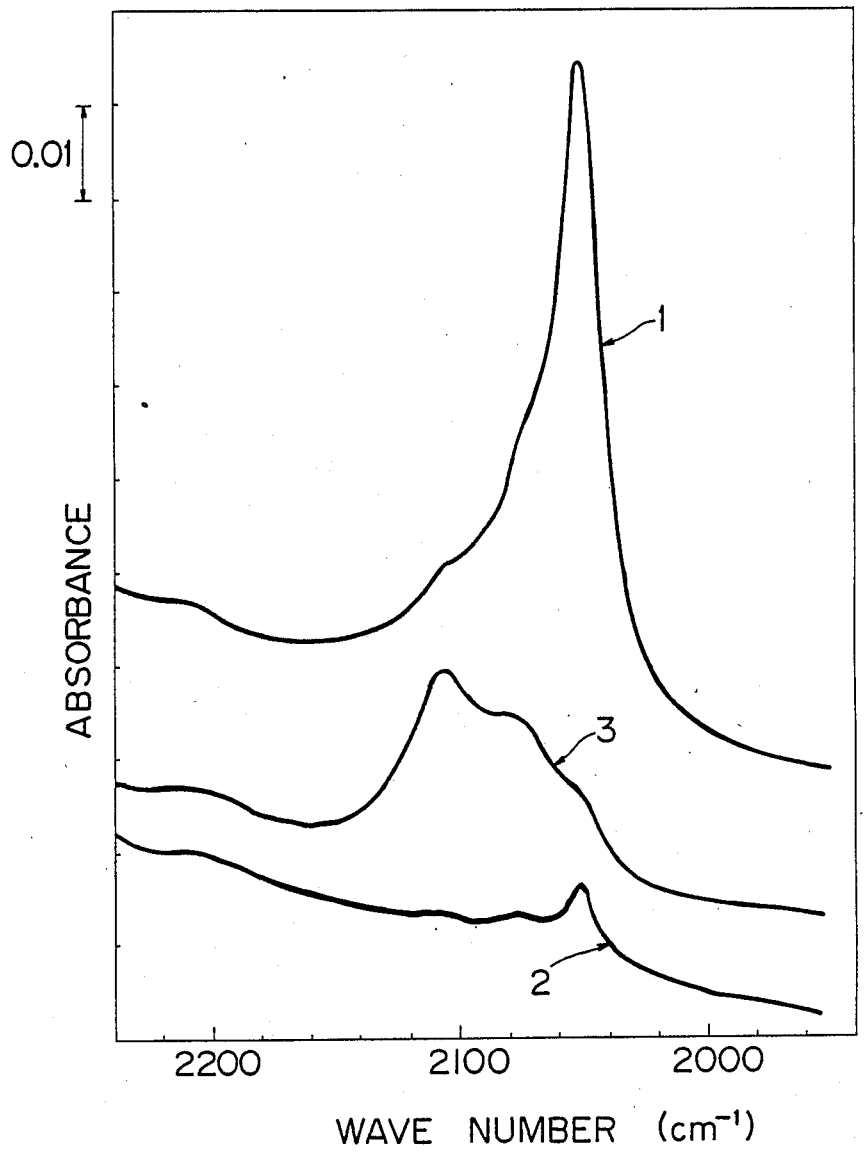

It is believed that the above wave numbers reflect the states of the thiocyanate ion present in the silver halide grains and 2106 $cm^{-1}$ corresponds to the ion adsorbed on the grain surface, 2073 $cm^{-1}$ corresponds to the ion otherwise adsorbed on the grain surface or the ion present on the subsurface area and 2052 $cm^{-1}$ corresponds to the state that the ion is embedded in the inner part of the grains.

In the present invention, the peak value of thiocyanate ion at 2052 $cm^{-1}$ sometimes changes by $\pm$ about 10 $cm^{-1}$ depending on the halogen composition of the silver halide grains and the amount of thiocyanate ion present.

In the present invention, the absorbance measured by the aforesaid method is preferably 0.02 or higher and more preferably 0.04 or higher. The absorbance is usually not higher than 0.2.

The IR spectroscopic absorbance of thiocyanate in the silver halide grains may be measured by the following procedure. All operations are preferably done under a safelight.

First, the emulsion or coated emulsion is subjected to an action of commercially available protease and, then, the silver halide grains are precipitated by centrifugation and thoroughly washed with distilled water, subsequently washed on a paper filter with an aqueous KBr solution of a concentration of 10 g/l for one minute and further washed with distilled water. Here, the washing with the aqueous KBr solution is to remove thiocyanate which is presumably present near the grain surface so as to exclude interference of IR absorption at 2106 $cm^{-1}$ and 2073 $cm^{-1}$. Then, 10 mg of the silver halide powder is shaped into a tablet of 2.5 mm in diameter using a tablet moulding device. Total pressure of 250 kg is applied to the tablet of 2.5 mm in diameter for 1 minute so that the influence of pressure is made constant. When tablet moulding devices of different sizes are used, the amount of the silver halide powder used and the total pressure during compression are increased or decreased proportionally to the surface area of tablet. A Fourier transformation IR spectrometer is used for the measurement of IR absorption of the silver halide tablets. Absorbance in a range of 4000 to 400 $cm^{-1}$ is measured with resolution of 4 $cm^{-1}$. The absorbance of the absorption by thiocyanate around 2052 $cm^{-1}$ is obtained as a difference in absorbance from a peak top around 2052 $cm^{-1}$ to base line which is drawn from the foot on the higher wave number side (around 2160 $cm^{-1}$) to the foot on the lower wave number side (around 2000 $cm^{-1}$).

In order to increase the absorbance of IR absorption of thiocyanate ion at 2052 $cm^{-1}$, it is necessary to limit an excess amount of the halide during formation of precipitates in the presence of thiocyanate. The excess amount is preferably 20 mol.% or lower, more preferably 4 mol.% or lower, particularly 2 mol.% or lower. Further, an excess amount of water-soluble silver salts may be present.

Increase in absorbance may also be attained by using a solvent for silver halides or controlling a pH. For instance, the solvent for silver halide is preferably used in an amount of $1\times10^{-2}$ to 10 mole/mole of Ag. The absorbance increases with the increasing amount of the added solvent. The absorbance may be increased by raising a pH, preferably, to 1 or higher.

Examples of thiocyanate used in the present invention include alkali metal salts such as NaSCN and KSCN and water-soluble salts such as $NH_4SCN$.

The amount of thiocyanate used is preferably in a range of 0.5 to 60 mol.%, more preferably 2 to 40 mol.%, based on the water-soluble silver salts used.

In order to obtain the absorbance of thiocyanate ion at 2052 $cm^{-1}$ of 0.015 or higher, it is necessary to conduct the formation of silver halide grains in the presence of thiocyanate. Preferably, thiocyanate is provided in a reactor before 95%, more preferably 90%, of the total amount of water-soluble silver salts used is added. It is particularly preferred that thiocyanate is provided before commencement of the formation of the silver halide grains.

Any silver halide out of silver bromide, silver iodobromide, silver iodochlorobromide, silver chlorobromide, silver iodochloride and silver chloride may be used in photographic emulsion used in the present invention. Preferred silver halide is silver iodobromide or iodochlorobromide containing not higher than 30 mol.% silver iodide. Silver iodobromide containing 2 to 25 mol.% silver iodide is particularly preferred.

The silver halide grains in the photographic emulsions may be so-called regular grains having a regular crystal form such as cubic, octahedron or fourteenhedron. Alternatively, the grains may be of an irregular crystal structure such as spherical, or ones having crystal defects such as a twinning plane, or composite form thereof.

Regarding a grain size of silver halide, the grains may be fine grains having a size of 0.1μ or less, or may be large size grains having a diameter of the projected area of up to 10μ. They may be monodispersed grains having a narrow distribution or polydispersed grains having a broad distribution.

The silver halide photographic emulsion which may be used in the invention may be prepared by known methods, such as those described in Research Disclosure No. 17643 (December, 1978), p 22 & 23, "I. Emulsion preparation and types", No. 18716 (November, 1979), p 648.

Photographic emulsions to be used in the present invention may be prepared according to, for instance, the methods described in P. Glafkides, Chimie et Physique Photographique, Paul Montel, 1967; G. F. Duffin, Photographic Emulsion Chemistry, Focal Press, 1966; and V. L. Zelikman et al, Making and Coating Photographic Emulsion, Focal Press, 1964. That is, any of an acid method, neutral method and ammoniacal method may be used. Further, a single-jet, simultaneous jet method or a combination thereof may be used for reacting a soluble silver salt with a soluble halogen salt. A method of forming grains in silver ion-excessive condition, i.e., so-called reverse jet method, may be used. As one of the simultaneous jet method, a method where pAg is maintained constant in a liquid phase in which silver halide forms, i.e., controlled double jet method, may also be used. This method yields silver halide emulsion in which a crystal form is regular and a grain size is uniform.

It is also possible to mix more than two silver halides which have separately been formed.

The aforesaid silver halide emulsion having regular grains is obtained by controlling pAg and pH during the formation of grains. Details are disclosed in, for instance, Photographic Science and Engineering, vol. 6, p 159 to 165 (1962), Journal of Photographic Science, vol. 12, p 242 to 251 (1964), U.S. Pat. No. 3,655,394 and UK Pat. No. 1,413,748.

A typical monodispersed emulsion contains silver halide whose average grain size is larger than 0.1μ and of which at least 95% by weight has a grain size within the average grain size ±40%. An emulsion containing silver halide whose average grain size is 0.25 to 2μ and of which at least 95% by weight or by number has a grain size within the average grain size ±20% may be used in the present invention. Methods for the preparation of such an emulsion are described in U.S. Pat. Nos. 3,574,628 and 3,655,394 and UK Pat. No. 1,413,748. Further, monodispersed emulsions as described in Japanese Patent Applications Nos. (OPI, i.e. unexamined published application) 8600/1973, 39027/1976, 83097/1976, 137133/1978, 48521/1979, 99419/1979, 37635/1983 and 49938/1983 may preferably be used in the present invention.

Alternatively, flat grains which have an aspect ratio of 5 or more may be used in the present invention. Such flat grains may be prepared by methods disclosed in Gutoff, Photographic Science and Engineering, Vol. 14, 248–257 (1970); U.S. Pat. Nos. 4,434,226; 4,414,310; 4,433,048; and 4,439,520; and UK Pat. No. 2,112,157. The aforesaid U.S. Pat. No. 4,434,226 describes in detail that, when the flat grains are used, advantages such as enhanced color sensitization efficiency by sensitizing dye, improvement of graininess and sharpness can be obtained.

Grains may have homogeneous crystal structure or may have different silver halide compositions in the inner part and the outer part or may have layered structure. Such emulsion grains are disclosed in UK Pat. No. 1,027,146, U.S. Pat. Nos. 3,505,068 and 4,444,877, and Japanese Patent Application No. (OPI) 143331/1985. Two or more types of silver halides which have different compositions may be connected by epitaxial connection. Alternatively, silver halide may be connected with compounds other than silver halide, such as rhodan silver and lead oxide. Such emulsion grains are disclosed in U.S. Pat. Nos. 4,094,684; 4,142,900; 4,459,353; 4,349,622; 4,395,478; 4,433,501; 4,463,087; 3,656,962; and 3,852,067; UK Pat. No. 2,038,792; and Japanese Patent Application No. (OPI) 162540/1984.

It is also possible to use a mixture of various crystal types of grain.

Cadmium salts, zinc salts, lead salts, thallium salts, iridium salts or complex salts thereof, rhodium salts or complex salts thereof, iron salts or iron complex salts may be present in the course of the formation of the silver halide grains or physical ripening.

Solvents for silver halide may be used during the formation of the silver halide grains used in the invention to control growth of the grains, such as ammonia, thioether compounds (U.S. Pat. Nos. 3,271,157, 3,574,628, 3,704,130, 4,297,439 and 4,276,347), thion compounds (Japanese Patent Application (OPI) 144319/1978, 82408/1978 and 77737/1980) and amine compounds (Japanese Patent Application No. (OPI) 100717/1979).

The silver halide emulsion used in the method according to the invention may or may not be chemically sensitized.

In the case of chemical sensitization, usual sulfur sensitization, reduction sensitization, noble metal sensitization or combinations thereof may be used.

Examples of chemical sensitizing agents include sulfur sensitizing agents such as allyl thiocarbamide, thiourea, thiosulfate, thioether and crystine; noble metal sensitizing agents such as potassium chloroaurate, aurous thiosulfate and potassium chloropalladate; reduction sensitizing agents such as tin chloride, phenylhydrazine and reductone.

The emulsion according to the invention is usually used after being subjected to physical ripening, chemical ripening and spectral sensitization. Additives used in such processes are described in Research Disclosure Vol. 176, No. 17643 (December, 1978) and Vol. 187, No. 18716 (November, 1979), whose relevant parts are summarized in the following table.

Known photographic additives capable of being used in the present invention are also described in the above two Research Disclosures, whose relevant parts are shown in the following table.

| Additive | RD17643 | RD18716 |
|---|---|---|
| 1. Chemical sensitizing agent | Page 23 | Page 648, right column |
| 2. Sensitivity enhancing agent | | Page 648, right column |
| 3. Spectral sensitizing agent | Pages 23 and 24 | Page 648, right column |
| 4. Super sensitizing agent | | Page 649, right column |
| 5. Brightening agent | Page 24 | |
| 6. Antifoggant, Fogging stabilizing agent | Pages 24 and 25 | Page 649, right column |
| 7. Coupler | Page 25 | |
| 8. Organic solvent | Page 25 | |
| 9. Light absorbing agent, Filter dye, UV absorbing agent | Pages 25 and 26 | Page 649, right column to page 650, left column |
| 10. Antistain agent | Page 25, right column | Page 650, left to right column |
| 11. Dye image stabilizing agent | Page 25 | |
| 12. Hardening agent | Page 26 | Page 651, left column |
| 13. Binder | Page 26 | Page 651, left column |
| 14. Plasticizer, Lubricant | Page 27 | Page 650, right column |
| 15. Coating aid, Surface activator | Pages 26 and 27 | Page 650, right column |
| 16. Antistatic | Page 27 | Page 650, right column |

The silver halide emulsion of the invention may be used in black-and-white silver halide photographic materials such as X ray sensitive materials, litho-films and black-and-white negative films for taking photographs, and color photographic materials such as color negative films, color reversal films and color papers. It may also be used in light-sensitive materials for diffusion transfer such as color diffusion transfer elements and silver salt diffusion transfer elements, and black-and-white and color heat development light-sensitive materials.

EXAMPLES

The present invention will further be explained by working examples in detail.

EXAMPLE 1

(1) Preparation of emulsion and coated sample

Emulsion 1 according to the invention was prepared as follows:

To 1 l of an aqueous solution kept at 60° C. containing 20 g of inactive gelatine, 4 g of KI and 9.7 g of KSCN, there were added an aqueous solution containing 50 g of $AgNO_3$ complexed with 2 equivalent of $NH_3$ and an aqueous solution containing 36 g of KBr over a period of 10 minutes, simultaneously. Then, a neutral aqueous solution containing 150 g of $AgNO_3$ and an aqueous solution containing 114 g of KBr were simultaneously added over a period of 20 minutes and ripened for 35 minutes, after which it was subjected to desalting and washing by a conventional precipitation method and chemically sensitized by gold-sulfur sensitization using chloroautic acid and sodium thiosulfate. Then, 4-hydroxy-6-methyl-1,3,3a,7-tetrazaindene was added as a stabilizing agent. A light-sensitive silver iodobromide emulsion (emulsion 1; silver iodide 2 mol.%) having an average grain size of 1.1$\mu$ was prepared.

Emulsion-2 for comparison was prepared as follows:

To 1l of an aqueous solution kept at 65° C. containing 20 g of inactive gelatine, 4 g of KI and 9.7 g of KSCN, there were added an aqueous solution containing 50 g of $AgNO_3$ complexed with 2 equivalent $NH_3$ and an aqueous solution containing 60 g of KBr over a period of 10 minutes, simultaneously. Then, $NH_3$ was neutralized by acid, and a neutral aqueous solution containing 150 g of $AgNO_3$ and an aqueous solution containing 90 g of KBr were simultaneously added over a period of 20 minutes and allowed to stand for 35 minutes. Subsequently, desalting and chemical sensitization were conducted as in emulsion 1. A stabilizing agent was added to yield a light-sensitive silver iodobromide emulsion (emulsion-2) having an average grain size of 1.1$\mu$.

To each of the emulsions thus obtained, there were added dodecylbenzenesulfonate as a coating aid, p-vinylbenzenesulfonate as a thickner, vinylsulfone compound as a hardener and polyethyleneoxide compound as a photographic property-improving agent to obtain an emulsion coating liquid. Then, each of the coating liquids thus prepared was evenly coated on a pretreated polyester base, on which a surface protective layer consisting mainly of an aqueous gelatine solution was coated to obtain coated sample 1 having emulsion 1 according to the invention and coated sample 2 having emulsion 2 for comparison. Both in samples 1 and 2, the amount of the coated silver was 4.0 g/cm$^2$; the amount of the coated gelatine of the protective layer, 1.3 g/m$^2$; and the amount of the coated gelatine of the emulsion layer, 2.7 g/cm$^2$.

(2) Measurement of IR spectroscopic absorption of emulsion grain

Each of emulsions 1 and 2 was subjected to an action of protease, Pronase P (trademark), produced by Kaken Kagaku Co., at 40° C. for 2 hours to digest gelatine. Then, silver halide was precipitated by centrifugation and a supernatant was removed. The silver halide grains were washed by repeating re-dispersion in distilled water and centrifugation, further washed on a paper filter with an aqueous solution of KBr of a concentration of 10 g/l, washed with distilled water and dried. 10 mg of the silver halide grains thus obtained were compressed by a micro tablet moulding device (Model MPD-1, Hitachi Seisakusho Co.) at total pressure of 250 kg for 1 minute to prepare a tablet of 2.5 mm in diameter. Measurement of IR spectroscopic absorption was conducted at room temperature with resolution of 4 cm$^{-1}$ between 4000 to 400 cm$^{-1}$ using a Fourier transformation IR spectroscope (Model JIR 40, Nippon Denshi Co.). Integration was repeated 40 times. A glober (silicon type heater) was used as a light source, TGS (Tri-glycerine-Sulfate) as a detector and Model IRB-2 of Hitachi Seisakusho Co. as a beam condensor. The absorbance of the absorption by thiocyanate around 2052 cm$^{-1}$ was obtained as a difference in absorbance from a peak top at 2052 cm$^{-1}$ to a base line which was drawn from a point at 2160 cm$^{-1}$ to a point at 2000 cm$^{-1}$. Treatment of the samples and measurement operations were conducted under a safelight.

The accompanying figure shows some spectra thus obtained.

(3) Evaluation of coated sample

Sample pieces from coated samples 1 and 2 prepared in item (1) above were exposed to light through a wedge, and developed at 35° C. for 25 seconds using an automatic developing machine (Model FPM-4000, Fuji Photo Film Co.) with a developing solution of the following composition after putting the machine in a running state by passing a light-sensitive material through and, then, subjected to fixing, water washing, drying and finally to sensitometry.

| (Composition of developing solution) | |
|---|---|
| Potassium hydroxide | 29.14 g |
| Glacial acetic acid | 10.96 g |
| Potassium sulfite | 44.20 g |
| Sodium bicarbonate | 7.50 g |
| Boric acid | 1.00 g |
| Diethylene glycol | 28.96 g |
| Ethylenediaminetetraacetic acid | 1.67 g |
| 5-Methylbenzotriazole | 0.06 g |
| 5-Nitroindazole | 0.25 g |
| Hydroquinone | 30.00 g |
| 1-Phenyl-3-pyrazolidone | 1.50 g |
| Glutaraldehyde | 4.93 g |
| Sodium hydrogen metasulfite | 12.60 g |
| Potassium bromide | 7.00 g |
| Water | to 1 l |
| pH | adjusted to 10.25 |

Other sample pieces were given bending pressure at a curvature of 6 mmϕ in an atmosphere of 25° C. and 60% R.H. and exposed to light through a wedge and similarly treated. Then sensitivity of the part which had been given the pressure was determined by sensitometry. Further, other sample pieces were exposed to light through a wedge, developed at 31° C. for 25 seconds using the same auto developing maching and the same developing solution and then subjected to fixing, water washing and drying. The sensitivity was determined by sensitometry.

The results obtained are summarized in Table 1.

there was added an aqueous solution containing 40 g of $AgNO_3$ over a period of 7 minutes. Then, an aqueous solution containing 160 g of $AgNO_3$ and an aqueous solution containing 105 g of KBr were added over a period of 20 minutes. Subsequently, desalting and washing by a conventional precipitation method, and chemical sensitization by a gold-sulfur sensitizing method using chloroautic acid and sodium thiosulfate were conducted. 4-Hydroxy-6-methyl-1,3,3a,7-tetrazaindene was added as a stabilizing agent. A light-sensitive silver iodobromide emulsion (emulsion 3, silver iodide 4 mol.%) having an average size of 0.9μ was obtained.

Emulsion 4 for comparison was prepared as follows.

The procedure for emulsion 3 was repeated with the exception that the amount of KSCN in the first aqueous gelatine solution was 3.0 g and a reaction temperature was 65° C. A light-sensitive silver iodobromide (emulsion 4) having an average size of 0.9μ was obtained.

To each of the emulsions thus obtained, there were added dodecylbenzenesulfonate as a coating aid, p-vinylbenzenesulfonate as a thickner, vinylsulfone compound as a hardener and 4,5-dihydro-2,4-diphenyl-5-phenylimino-1H-triazolium innersalt salicylic acid salt as a photographic property-improving agent and oxamonomethinecyanine dye to obtain an emulsion coating liquid. Then, each of the coating liquids thus prepared was evenly coated on a pretreated polyester base, on which a surface protective layer of an aqueous gelatine solution containing polymethylmethacrylate of an average diameter of 3 μ was coated to obtain coated sample 3 having emulsion 3 according to the invention and coated sample 4 having emulsion 4 for comparison. Both in samples 3 and 4, the amount of the coated silver was 3.5 g/m$^2$; the amount of the coated gelatine of the protective layer, 1.1 g/m$^2$, and the amount of the coated gelatine of the emulsion layer, 2.5 g/m$^2$.

TABLE 1

| Coated Sample | Emulsion | Absorbance of Emulsion Grains at 2052 cm$^{-1}$ | Photographic Properties: Relative Sensitivity* | Photographic Properties: Fog Value | Relative Sensitivity* of Pressurized Part | Relative Sensitivity* in Development at 31° C. | |
|---|---|---|---|---|---|---|---|
| 1 | Emulsion 1 | 0.070 | 100 | 0.06 | 83 | 78 | Invention |
| 2 | Emulsion 2 | 0.008 | 90 | 0.06 | 68 | 67 | Comparison |

*Relative sensitivity is based on the sensitivity of coated sample 1 in the case of 35° C. (as 100).

As clear from Table 1, coated sample 1 which contains emulsion 1 according to the invention having an absorbance of 0.015 or more of the emulsion grains at 2052 cm$^{-1}$ has higher relative sensitivity, smaller loss of sensitivity by pressure and smaller decrease of sensitivity in lower temperature development. Thus, the effects of the invention are remarkable.

EXAMPLE 2

(1) Preparation of emulsion and coated sample

First, emulsion 3 was prepared as follows.

To 1 l of an aqueous solution kept at 50° C. containing 20 g of inactive gelatine, 8 g of KI, 45 g of KBr, 9.7 g of KSCN and 35 cc of an aqueous 25 wt. % $NH_3$ solution, (2) Measurement of IR spectroscopic absorption of emulsion grain The measurement was conducted as described in item (2) of Example 1. The absorbance of thiocyanate ion per 10 mg of the emulsion grains around 2052 cm$^{-1}$ was 0.020 for emulsion 3; and 0.010 for emulsion 4.

(3) Evaluation of coated sample

Sensitometry to evaluate pressure dependency and development temperature dependency was conducted for sample pieces from coated samples 3 and 4 prepared in item (1) above, by the same method as in item (3) of Example 1.

The results obtained are summarized in Table 2.

TABLE 2

| Coated Sample | Emulsion | Absorbance of Emulsion Grains of 2052 cm$^{-1}$ | Photographic Properties: Relative Sensitivity* | Photographic Properties: Fog Value | Relative Sensitivity* of Pressurized Part | Relative Sensitivity* in Development at 31° C. | |
|---|---|---|---|---|---|---|---|
| 3 | Emulsion 3 | 0.020 | 100 | 0.03 | 90 | 76 | Invention |

TABLE 2-continued

| Coated Sample | Emulsion | Absorbance of Emulsion Grains of 2052 $cm^{-1}$ | Photographic Properties Relative Sensitivity* | Photographic Properties Fog Value | Relative Sensitivity* of Pressurized Part | Relative Sensitivity* in Development at 31° C. | |
|---|---|---|---|---|---|---|---|
| 4 | Emulsion 4 | 0.010 | 87 | 0.03 | 72 | 60 | Comparison |

*Relative sensitivity is based on the sensitivity of coated sample 3 in the case of 35° C. (as 100).

As clear from Table 2, coated sample 3 containing emulsion 3 of the invention having an absorbance not less than 0.015 has better relative sensitivity, pressure resistance and treatment stability than coated sample 4 containing comparative emulsion 4 having an absorbance less than 0.015. Thus, the effects of the invention are remarkable.

EXAMPLE 3

As for the emulsions described in Examples 1 to 7 of U.S. Pat. No. 3,320,069, absorbances of thiocyanate ion per 10 mg of the emulsion grains around 2052 $cm^{-1}$ were measured according to the method described in item (2) of Example 1 above. All of the absorbances obtained were below 0.008.

We claim:

1. A thiocyanate-containing silver halide emulsion characterized in that a disc tablet of 2.5 mm in diameter formed of 10 mg of silver halide contained in the silver halide emulsion shows an absorbance of 0.015 or higher of thiocyanate ion at 2052 $cm^{-1}$, measured by Infra red spectroscopy.

2. The silver halide emulsion according to claim 1, wherein the absorbance is in a range of 0.02 to 0.2.

3. The silver halide emulsion according to claim 1, wherein the absorbance is in a range of 0.04 to 0.2.

4. The silver halide emulsion according to claim 1, wherein the silver halide is silver ioodobromide or silver iodochlorobromide containing 30 mol. % or less or silver iodide.

* * * * *